US011521529B2

(12) United States Patent
Xiao

(10) Patent No.: US 11,521,529 B2
(45) Date of Patent: Dec. 6, 2022

(54) ELECTROSTATIC IGNITION PROTECTION METHOD OF SOURCE DRIVER OF DISPLAY DEVICE AND DISPLAY DEVICE

(71) Applicant: TCL China Star Optoelectronics Technology Co., Ltd., Shenzhen (CN)

(72) Inventor: Guangxing Xiao, Shenzhen (CN)

(73) Assignee: TCL China Star Optoelectronics Technology Co., Ltd., Shenzhen (CN)

( * ) Notice: Subject to any disclaimer, the term of this patent is extended or adjusted under 35 U.S.C. 154(b) by 347 days.

(21) Appl. No.: 16/761,512

(22) PCT Filed: Apr. 3, 2020

(86) PCT No.: PCT/CN2020/083141

§ 371 (c)(1),
(2) Date: May 5, 2020

(87) PCT Pub. No.: WO2021/179375

PCT Pub. Date: Sep. 16, 2021

(65) Prior Publication Data

US 2022/0108643 A1 Apr. 7, 2022

(30) Foreign Application Priority Data

Mar. 11, 2020 (CN) ..... 202010164394.X

(51) Int. Cl.
*G09G 3/20* (2006.01)

(52) U.S. Cl.
CPC ..... *G09G 3/20* (2013.01); *G09G 2310/0275* (2013.01); *G09G 2310/08* (2013.01); *G09G 2330/021* (2013.01); *G09G 2330/04* (2013.01); *G09G 2330/06* (2013.01)

(58) Field of Classification Search
CPC ..... G09G 2310/0275; G09G 3/20; G09G 2310/08; G09G 2330/04; G09G 2330/021; G09G 2330/06
See application file for complete search history.

(56) References Cited

U.S. PATENT DOCUMENTS

2012/0242644 A1* 9/2012 Liu ..... G09G 3/20 345/212
2014/0043314 A1 2/2014 Park
2014/0085290 A1* 3/2014 Yu ..... G09G 3/3208 345/212
2015/0372589 A1 12/2015 Zhang et al.
(Continued)

FOREIGN PATENT DOCUMENTS

CN 103578397 2/2014
CN 103680378 3/2014
(Continued)

*Primary Examiner* — Gerald Johnson
(74) *Attorney, Agent, or Firm* — PV IP PC; Wei Te Chung; Ude Lu

(57) ABSTRACT

An electrostatic ignition protection method of a source driver of a display device and a display device are provided. When a time controller detects that a source driver has static electricity, the time controller controls the source driver not to output a driving signal for a preset duration and the preset duration is greater than an ignition threshold duration. This prevents the source driver having static electricity from accumulating enough heat in a short time to burn and fire.

13 Claims, 5 Drawing Sheets

(56) References Cited

U.S. PATENT DOCUMENTS

| | | | | |
|---|---|---|---|---|
| 2019/0147790 | A1 | 5/2019 | Chung et al. | |
| 2019/0204694 | A1 | 7/2019 | Wang et al. | |
| 2020/0090620 | A1* | 3/2020 | Zhou | G06F 3/147 |
| 2020/0279523 | A1* | 9/2020 | Nam | G09G 3/3677 |

FOREIGN PATENT DOCUMENTS

| | | |
|---|---|---|
| CN | 103810958 | 5/2014 |
| CN | 103972228 | 8/2014 |
| CN | 107068092 | 8/2017 |
| CN | 109785785 | 5/2019 |
| CN | 109992148 | 7/2019 |
| CN | 110718177 | 1/2020 |
| JP | 2005-300625 | 10/2005 |
| JP | 2008-136262 | 6/2008 |
| KR | 10-2013-0017367 | 2/2013 |

* cited by examiner

ELECTROSTATIC IGNITION PROTECTION METHOD OF SOURCE DRIVER OF DISPLAY DEVICE AND DISPLAY DEVICE

RELATED APPLICATIONS

This application is a National Phase of PCT Patent Application No. PCT/CN2020/083141 having International filing date of Apr. 3, 2020, which claims the benefit of priority of Chinese Patent Application No. 202010164394.X filed on Mar. 11, 2020. The contents of the above applications are all incorporated by reference as if fully set forth herein in their entirety.

FIELD AND BACKGROUND OF THE INVENTION

The present application relates to the field of display technologies, and more particularly to an electrostatic ignition protection method of a source driver of a display device and a display device.

At present, a source driver in a display device does not increase anti-static function, and a time controller (Tcon) connected to the source driver in the display device will conduct static electricity to the source driver, accumulation of static electricity in the source driver can cause a fire issue when the source driver is in operation.

Therefore, it is necessary to propose a technical solution to solve issues that the source driver fires during operation of the display device including the source driver due to accumulation of static electricity in the source driver.

SUMMARY OF THE INVENTION

An object of the present application is to provide an electrostatic ignition protection method of a source driver of a display device and a display device, so as to solve issues that the source driver fires and burns during operation of the display device including the source driver due to accumulation of static electricity.

In order to achieve the above object, an embodiment of the present application provides an electrostatic ignition protection method of a source driver of a display device. The display device comprises a time controller electrically connected to the source driver and a power management chip electrically connected to both the time controller and the source driver. The method comprises following steps: the time controller detecting whether the source driver has static electricity; if yes, the time controller controls the source driver not to output a driving signal for a preset duration and the preset duration is greater than an ignition threshold duration.

In the electrostatic ignition protection method of the source driver of the display device, the time controller detecting whether the source driver has static electricity comprises following steps: after the display device is powered on, the time controller outputs a first control signal to the power management chip; the power management chip outputting an operating low voltage to the source driver according to the first control signal; the source driver being in an operating state under action of the operating low voltage; the time controller and the source driver in the operating state performing a detection training to detect whether the source driver has static electricity; if the source driver has static electricity, the source driver pulls down a locked pin for training, and the detection training fails; and the time controller detecting that the source driver has static electricity according to a detection training failure.

In the electrostatic ignition protection method of the source driver of the display device, the time controller detecting whether the source driver has static electricity further comprises following steps: if the detection training fails, the time controller repeats the detection training with the source driver in the operating state N times to detect whether the source driver has static electricity, where N is an integer greater than 1; if results of all N times are yes, the time controller detects that the source driver has static electricity.

In the electrostatic ignition protection method of the source driver of the display device, a value range of the operating low voltage is greater than 0 V and less than 4 V.

In the electrostatic ignition protection method of the source driver of the display device, the time controller detecting whether the source driver has static electricity further comprises following steps: when the display device displays, a static electricity detection module detects whether the source driver has static electricity, and the source driver comprises the static electricity detection module; if the source driver has static electricity, the source driver outputs a static electricity notification signal to the time controller; the time controller detecting that the source driver has static electricity according to the static electricity notification signal.

In the electrostatic ignition protection method of the source driver of the display device, the time controller controlling the source driver not to output the driving signal for the preset duration comprises following steps: the time controller outputting a second control signal to the power management chip; the power management chip outputting an operating voltage of 0 to the source driver for the preset duration according to the second control signal; the source driver being in an inoperative state under action of the operating voltage of 0 for the preset duration.

In the electrostatic ignition protection method of the source driver of the display device, the time controller controlling the source driver not to output the driving signal for the preset duration comprises following steps: the time controller outputting a third control signal to the source driver; the source driver resetting a register in the source driver according to the third control signal.

In the electrostatic ignition protection method of the source driver of the display device, the time controller detecting whether the source driver has static electricity comprises following steps: the time controller detecting whether the source driver is in a short circuit state caused by static electricity.

A display device comprises a time controller; a source driver electrically connected to the time controller; and a power management chip electrically connected to both the time controller and the source driver. The time controller is configured to detect whether the source driver has static electricity, and when the source driver has static electricity, the time controller controls the source driver not to output a driving signal for a preset duration and the preset duration is greater than an ignition threshold duration.

In the display device, after the display device is powered on, the time controller outputs a first control signal to the power management chip, the time controller and the source driver in an operating state are configured to perform a detection training to detect whether the source driver has static electricity, and the time controller is configured to detect that the source driver has static electricity according to a detection training failure; the power management chip is configured to output an operating low voltage to the source driver according to the first control signal; the source driver is in the operating state under action of the operating low voltage and is configured to perform the detection training with the time controller, and if the source driver has static electricity, the source driver pulls down a locked pin for training, and the detection training fails.

In the display device, a value range of the operating low voltage is greater than 0 V and less than 4 V.

In the display device, the source driver comprises a static electricity detection module, the static electricity detection module detects whether the source driver has static electricity when the display device displays; if the source driver has static electricity, the source driver outputs a static electricity notification signal to the time controller; the time controller is further configured to detect that the source driver has static electricity according to the static electricity notification signal.

In the display device, the time controller is configured to output a second control signal to the power management chip; the power management chip is configured to output an operating voltage of 0 to the source driver for the preset duration according to the second control signal; the source driver is in an inoperative state under action of the operating voltage of 0 for the preset duration.

In the display device, the time controller is configured to output a third control signal to the source driver, and the source driver is configured to reset a register in the source driver according to the third control signal.

In the display device, the time controller is configured to detect whether the source driver is in a short circuit state caused by static electricity to detect whether the source driver has static electricity.

Beneficial Effect

Embodiments of the present application provide an electrostatic ignition protection method of a source driver of a display device and a display device. When a time controller detects that a source driver has static electricity, the time controller controls the source driver not to output a driving signal for a preset duration and the preset duration is greater than an ignition threshold duration. The source driver with static electricity will cause circuit of the source driver to be short-circuited. By preventing the source driver with static electricity from outputting a driving signal, the source driver is prevented from outputting a high-level signal. This avoids the high-level signal combined with short-circuit to produce large short-circuit currents, thereby preventing large short-circuit currents from generating large amounts of heat during an ignition threshold time, and preventing the source driver having static electricity from accumulating enough heat in a short time to burn and fire.

DESCRIPTION OF SPECIFIC EMBODIMENTS OF THE INVENTION

Technical solutions in embodiments of the present application will be described clearly and completely with reference to the drawings in the embodiments of the present application. Obviously, the described embodiments are only a part of the embodiments of the present application, but not all the embodiments. Based on the embodiments in the present application, all other embodiments obtained by those skilled in the art without making creative efforts fall within the protection scope of the present application.

Figure 1:
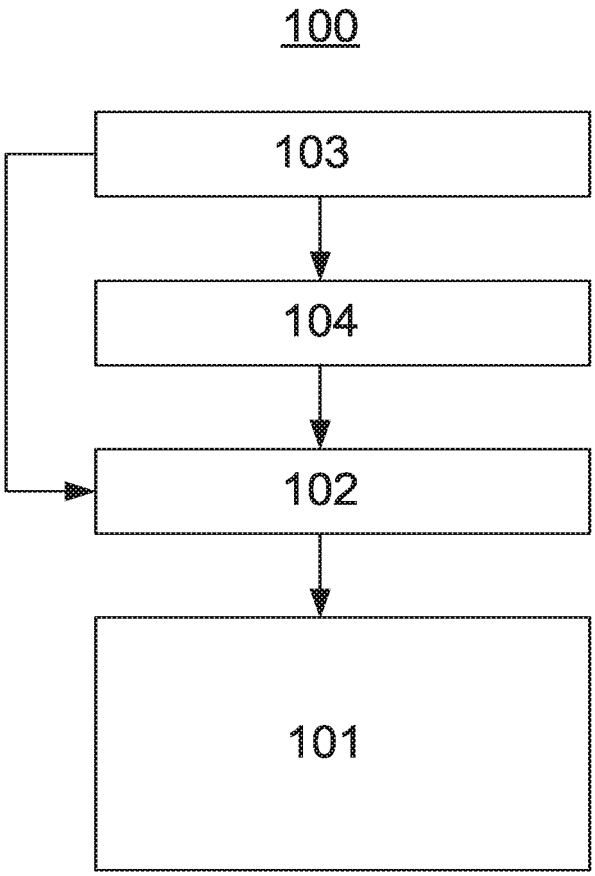
FIG. 1 is a schematic structural diagram of a display device according to an embodiment of the present application.

Referring to FIG. 1, which is a schematic structural diagram of a display device according to an embodiment of the present application. A display device 100 may be one of a liquid crystal display device or an organic light emitting diode display device. The display device 100 includes a display panel 101, a source driver 102, a time controller 103, and a power management chip 104. The time controller 103 is electrically connected to the source driver 102. The power management chip 104 is electrically connected to the time controller 103 and the source driver 102. The source driver 102 is electrically connected to the display panel 101.

When the display device 100 needs to display, the time controller 103 outputs a data control signal to the source driver 102. The source driver 102 outputs a driving signal according to the data control signal. The display panel 101 displays an image according to the driving signal.

The time controller 103 is connected to the power management chip 104. The time controller 103 outputs a control signal to the power management chip 104. The power management chip 104 provides an operating voltage to the source driver 102 according to the control signal. The operating voltage is 0, or the operating voltage comprises an operating low voltage and an operating high voltage.

When a locked signal of the source driver 102 is pulled low, the source driver 102 does not output a driving signal to the display panel 101. When the locked signal is pulled high, the source driver 102 outputs a driving signal to the display panel. The driving signal includes a low-level driving signal and a high-level driving signal. When the source driver 102 is in an inoperative state, the source driver 102 also does not output a driving signal to the display panel. When the source driver 102 does not output a drive signal to the display panel 101, the display panel 101 displays a black image.

The source driver 102 is electrically connected to the power management chip 104. When the operating voltage output from the power management chip 104 to the source driver 102 is 0, the source driver 102 is in an inoperative state. When the operating voltage output by the power management chip 104 to the source driver 102 is an operating low voltage or an operating high voltage, the source driver 102 is in an operating state.

In order to avoid static fire of the source driver with static electricity, the time controller 103 is configured to detect whether the source driver 102 has static electricity. The time controller 103 is configured to control the source driver 102 not to output a driving signal for a preset duration if the source driver 102 has static electricity, and the preset duration is greater than an ignition threshold duration.

A condition of combustion is heat Q generated during a time period less than an ignition threshold, where $Q=I^2Rt$, I represents a current value, t represents a duration of the current value I, and R represents a resistance of current I through a load. Static electricity in the source driver can cause a short circuit in the source driver. When there is a high-level signal in the short-circuited source driver, it will cause the source driver to generate a large current value. A large current value will cause the source driver with static electricity to generate enough heat to fire and burn in less than a ignition threshold time.

In the display device of an embodiment of the present application, when the time controller detects that the source driver has static electricity, the time controller controls the source driver not to output a driving signal for a preset duration and the preset duration is greater than an ignition threshold duration. The time controller is configured to detect whether the source driver is in a short circuit state caused by static electricity to detect whether the source driver has static electricity. The source driver with static electricity will cause circuit of the source driver to be short-circuited. By preventing the source driver with static electricity from outputting a driving signal, the source driver is prevented from outputting a high-level signal. This can prevent the source driver from generating a large current for a preset duration, and prevent the source driver from catching fire and burning.

In an embodiment of the present application, the time controller 103 detects whether the source driver 102 has static electricity according to different operating states of the display device. The operating state of the display device 100 includes after the display device 100 is powered on and when the display device 100 displays. After the display device 100 is powered on, both the power management chip 104 and the time controller 103 are in an operating state, and the display device 100 does not display images. When the display device 100 displays, the power management chip 104, the time controller 103, the source driver 102, and the display panel 101 are all in an operating state.

After the display device 100 is powered on, the time controller 103 outputs a first control signal to the power management chip 104. The power management chip 104 is configured to output an operating low voltage to the source driver 102 according to the first control signal. The source driver 102 is in an operating state under action of the operating low voltage. The time controller 103 and the source driver 102 in the operating state are configured to perform a detection training to detect whether the source driver 102 has static electricity. The source driver 102 is configured to perform the detection training with the time controller 103, and if the source driver 102 has static electricity, the source driver 102 pulls down a locked pin for training, and the detection training fails. The time controller 103 is also configured to detect static electricity in the source driver 102 according to a detection training failure.

Compared with a conventional technology, after the display device is powered on, the time controller controls the power management chip of the display device to output a voltage required by the source driver to the source driver. An operating voltage required for the source driver to operate includes an operating low voltage and an operating high voltage. Considering that the source driver may have static electricity, the display device is powered on to provide a high operating voltage to the source driver. Operating high voltage combined with static electricity causes the source driver to produce a short-circuit current with a high current value in a short time. The high-current short-circuit current will cause the source driver to generate a large amount of heat within an ignition threshold time, which will cause function to fail or fire. After the display device 100 is powered on, the time controller controls the power management chip 104 to output the operating low voltage to the source driver 102, so that some circuits in the source driver 104 operate at a low current value, for example, a logic control circuit and an analog circuit in the source driver. The operating low voltage is greater than 0 V and less than 4 V, such as 1.8 V and 3.3 V. The source driver 102 does not have issues of fire and burning.

In a conventional technology, the time controller 103 and the source driver 102 each have a pin for training. The training is based on its own protocols such as CSPI interface and USIT interface. The time controller 103 and the source driver 102 have pins for training, and the timing controller 103 outputs a detection training signal to the source driver 102. Based on its own protocols such as CSPI interface and USIT interface, the source driver 102 outputs a detection feedback signal to the time controller 103. When the source driver 102 has static electricity to be in a short-circuit state, the source driver 102 will pull down its pins for training. At this time, the source driver 102 does not output the detection feedback signal, and the detection training fails. The time controller 103 detects that the source driver has static electricity according to the detection training failure. When the source driver 102 has not failed, it will raise its pin for training. At this time, the source driver 102 outputs the detection feedback signal to the time controller 103.

When the display device 100 displays, the source driver 102 includes an electrostatic detection module. The electrostatic detection module is configured to detect whether the source driver 102 has static electricity when the display device 100 displays. If the source driver 102 has static electricity, the source driver 102 is configured to output a static electricity notification signal to the time controller 103. The time controller 103 is also configured to detect static electricity in the source driver 102 according to the static electricity notification signal.

When the display device 100 displays, the source driver 102 operates. By providing an electrostatic detection module in the source driver 102, the electrostatic detection module detects whether there is static electricity when the source driver 102 operates. If the source driver 102 has static electricity, it outputs a static electricity notification signal to the time controller. The time controller 103 detects that the source driver 102 has static electricity through the static electricity notification signal. The static electricity notification signal is transmitted by adding corresponding pins to the source driver 102 and the time controller 103, respectively.

If the source driver has static electricity, the time controller performs a hard reset or a soft reset on the source driver 102.

The hard reset means that the time controller controls the power management chip 104 of the display device 100 to output an operating voltage of 0 to the source driver 102 for a preset duration. Even if the source driver 102 is in an inoperative state for a preset duration. Specifically, the time controller 103 is configured to output the second control signal to the power management chip 104. The power management chip 104 is configured to output an operating voltage of 0 to the source driver 102 according to the second control signal for a preset duration. The source driver 102 is in an inoperative state for a preset duration under the action of the operating voltage being zero.

The time controller 103 controls the power management chip 104 to output an operating voltage of 0 to the source driver 102 for a preset duration. The source driver 102 is in an inoperative state. Never output drive signals to avoid high-level signals. Avoid generating a high current in combination with a high-level signal and a short circuit, causing the source driver 102 to fire and burn within the ignition threshold time.

Soft reset means that the time controller 103 resets registers (including temporary storage instructions, data, and addresses) in the source driver 102, so that a locked signal of the source driver 102 is low, and the source driver 102 will not output the drive signal. Specifically, the time controller 103 is configured to output the third control signal to the source driver 102. The source driver 102 is configured to reset the register in the source driver 102 according to the third control signal.

It should be noted that, when the display device displays, the source driver 102 does not output a driving signal for a preset duration. The display panel will display a black image for a preset duration. In addition, after a preset duration, the time controller 103 re-sends the instruction to the power management chip 104 of the display device 100. The power management chip 104 outputs a normal operating voltage to the source driver 102 according to the instruction, and the source driver 102 operates normally. The time controller 103 sends a data control signal to the source driver 102 again. The source driver 102 outputs a driving signal to the display panel 101, and drives the display panel 101 to display a normal image.

Figure 2:
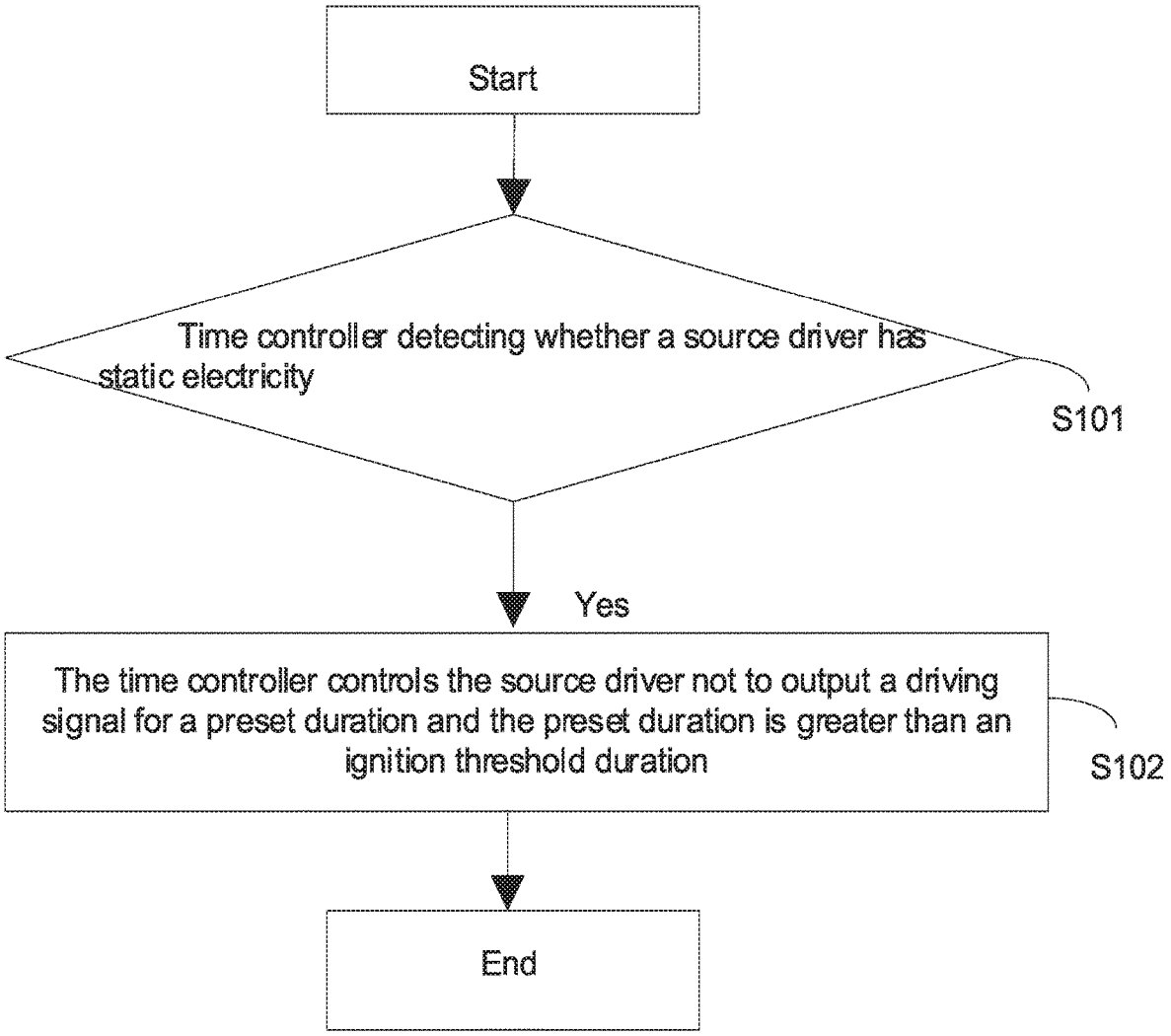
FIG. 2 is a schematic flowchart of an electrostatic ignition protection method of a source driver of a display device according to an embodiment of the present application.

Referring to FIG. 2, which is a schematic flowchart of an electrostatic ignition protection method of a source driver of a display device according to an embodiment of the present application. A display device comprises a time controller electrically connected to the source driver and a power management chip electrically connected to both the time controller and the source driver. An electrostatic ignition protection method of the source driver of the display device comprises following steps:

S101, the time controller detecting whether the source driver has static electricity.

Specifically, the time controller detects whether the source driver is in a short circuit state caused by static electricity to detect whether the source driver has static electricity. If the source driver is in a short-circuit state caused by static electricity, the source driver is detected to have static electricity. If the source driver is not in a short-circuit state caused by static electricity, the source driver has no static electricity.

S102, if yes, the time controller controls the source driver not to output a driving signal for a preset duration and the preset duration is greater than an ignition threshold duration.

Specifically, when the display device is powered on and the display device displays, the power management chip of the display device can be controlled to output an operating voltage of 0 to the source driver for a preset duration. This causes the source driver to be in an inoperative state for a preset duration. The source driver does not output a driving signal for a preset duration. For example, the time controller outputs a second control signal to the power management chip, and the power management chip outputs an operating voltage of 0 to the source driver for a preset duration according to the second control signal. The source driver is in an inoperative state when the operating voltage is zero.

When the display device displays, the register in the source driver can also be reset (soft reset), so that the locked signal of the source driver is pulled low. The source driver does not output a driving signal for a preset duration. For example, the time controller outputs a third control signal to the source driver, and the source driver resets the register in the source driver according to the third control signal.

In the electrostatic ignition protection method of the source driver of the display device of the embodiment of the present application, when the time controller detects that the source driver has static electricity, the time controller controls the source driver not to output a driving signal for a preset duration and the preset duration is greater than an ignition threshold duration. This prevents the source driver having static electricity from accumulating enough heat in a short time to burn and fire.

Figure 3:
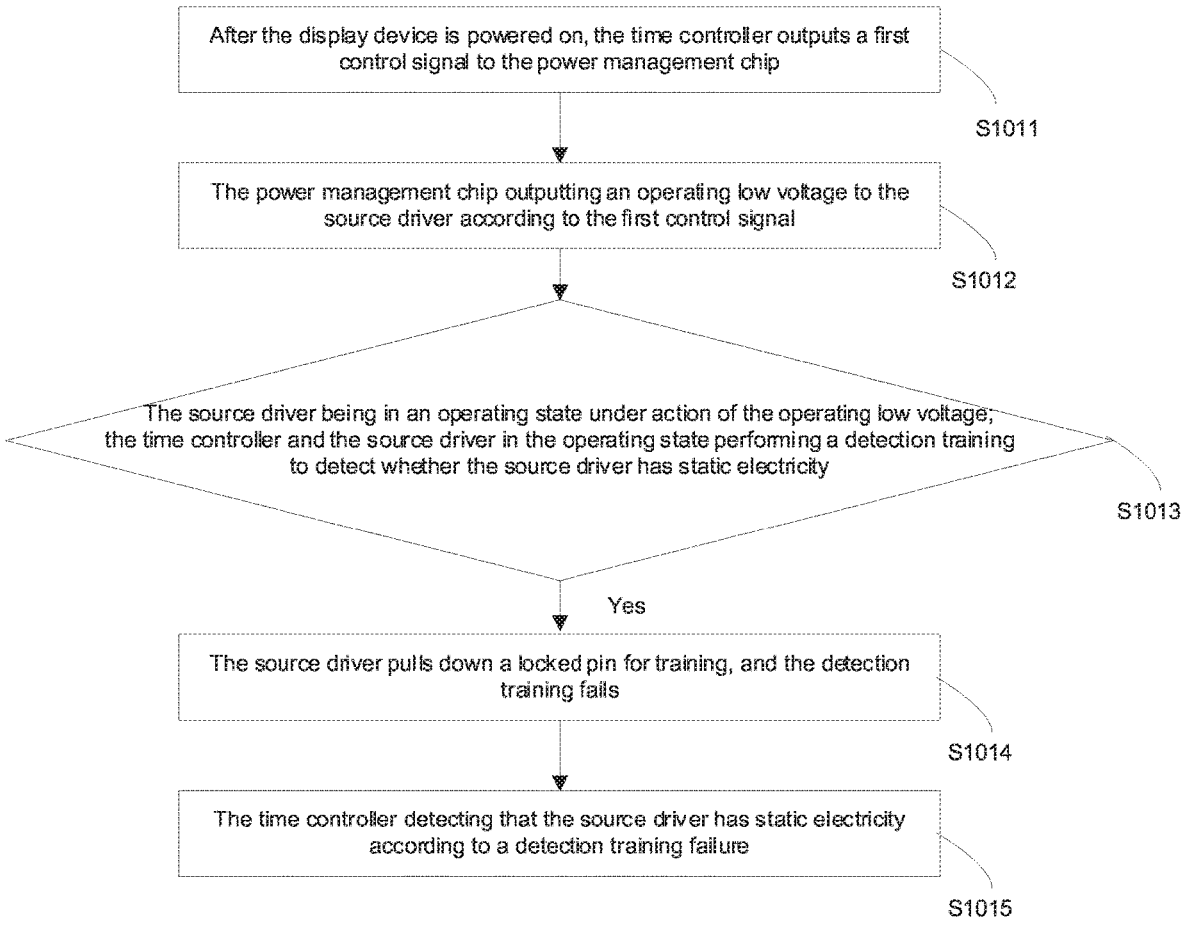
FIG. 3 is a schematic flowchart of a time controller detecting whether a source driver has static electricity according to an embodiment of the application.

Referring to FIG. 3, which is a schematic flowchart of a time controller detecting whether a source driver has static electricity according to an embodiment of the application. The time controller detecting whether the source driver has static electricity comprises following steps:

S1011, after the display device is powered on, the time controller outputs a first control signal to the power management chip.

S1012, the power management chip outputting an operating low voltage to the source driver according to the first control signal.

S1013, the source driver being in an operating state under action of the operating low voltage; the time controller and the source driver in the operating state performing a detection training to detect whether the source driver has static electricity.

S1014, if the source driver has static electricity, the source driver pulls down a locked pin for training, and the detection training fails.

S1015, the time controller detecting that the source driver has static electricity according to a detection training failure.

Figure 4:
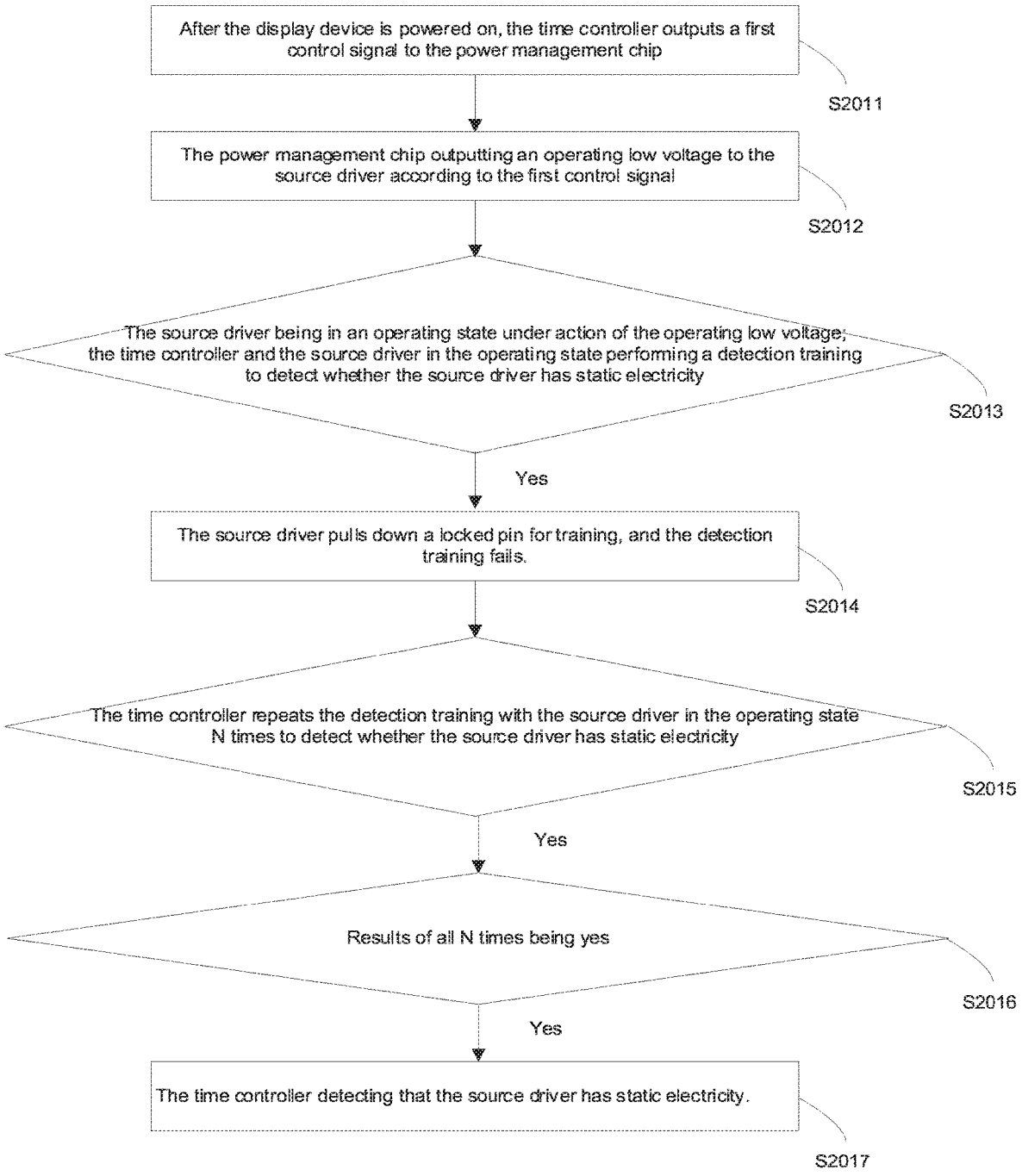
FIG. 4 is a schematic flowchart of a time controller detecting whether a source driver has static electricity according to another embodiment of the present application.

Referring to FIG. 4, which is a schematic flowchart of a time controller detecting whether a source driver has static electricity according to another embodiment of the present application. The time controller detecting whether the source driver has static electricity further comprises following steps:

S2011, after the display device is powered on, the time controller outputs a first control signal to the power management chip.

S2012, the power management chip outputting an operating low voltage to the source driver according to the first control signal.

S2013, the source driver being in an operating state under action of the operating low voltage; the time controller and the source driver in the operating state performing a detection training to detect whether the source driver has static electricity.

S2014, if the source driver has static electricity, the source driver pulls down a locked pin for training, and the detection training fails.

S2015, if the detection training fails, the time controller repeats the detection training with the source driver in the operating state N times to detect whether the source driver has static electricity, where N is an integer greater than 1.

S2016, if results of all N times are yes;

S2017, the time controller detects that the source driver has static electricity.

Relative to only one detection training and corresponding detection results, to detect whether the source driver has static electricity, multiple detection training and determining the results of multiple detection training will increase accuracy of the detection results.

Figure 5:
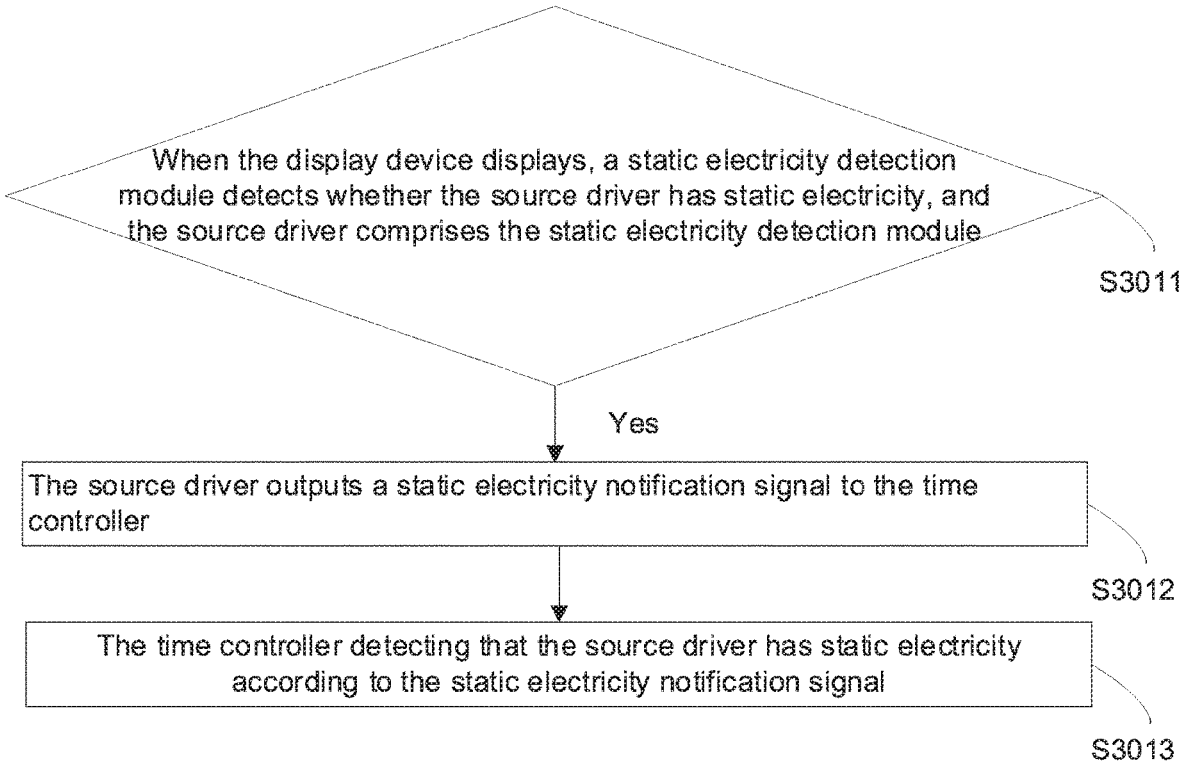
FIG. 5 is a schematic flowchart of a time controller detecting whether a source driver has static electricity according to another embodiment of the present application.

Referring to FIG. 5, which is a schematic flowchart of a time controller detecting whether a source driver has static electricity according to another embodiment of the present application. The time controller detecting whether the source driver has static electricity comprises following steps:

S3011, when the display device displays, a static electricity detection module detects whether the source driver has static electricity, and the source driver comprises the static electricity detection module.

S3012, if the source driver has static electricity, the source driver outputs a static electricity notification signal to the time controller.

S3013, the time controller detecting that the source driver has static electricity according to the static electricity notification signal.

The descriptions of the above embodiments are only used to help understand the technical solutions and core ideas of the present application. Those of ordinary skill in the art should understand that they can still modify the technical solutions described in the foregoing embodiments, or equivalently replace some of the technical features. However, these modifications or substitutions do not deviate from the scope of the technical solutions of the embodiments of the present application.

What is claimed is:

1. An electrostatic ignition protection method of a source driver of a display device, the display device comprising a time controller electrically connected to the source driver and a power management chip electrically connected to both the time controller and the source driver, wherein the method comprises following steps:

the time controller detecting whether the source driver has static electricity;

if yes, the time controller controls the source driver not to output a driving signal for a preset duration and the preset duration is greater than an ignition threshold duration;

wherein the time controller detecting whether the source driver has static electricity comprises following steps:

after the display device is powered on, the time controller outputs a first control signal to the power management chip;

the power management chip outputting an operating low voltage to the source driver according to the first control signal;

the source driver being in an operating state under action of the operating low voltage;

the time controller and the source driver in the operating state performing a detection training to detect whether the source driver has static electricity;

if the source driver has static electricity, the source driver pulls down a locked pin for training, and the detection training fails; and the time controller detecting that the source driver has static electricity according to a detection training failure.

2. The electrostatic ignition protection method of the source driver of the display device according to claim 1, wherein the time controller detecting whether the source driver has static electricity further comprises following steps:

if the detection training fails, the time controller repeats the detection training with the source driver in the operating state N times to detect whether the source driver has static electricity, where N is an integer greater than 1;

if results of all N times are yes, the time controller detects that the source driver has static electricity.

3. The electrostatic ignition protection method of the source driver of the display device according to claim 1, wherein a value range of the operating low voltage is greater than 0 V and less than 4 V.

4. The electrostatic ignition protection method of the source driver of the display device according to claim 1, wherein the time controller detecting whether the source driver has static electricity further comprises following steps:

when the display device displays, a static electricity detection module detects whether the source driver has static electricity, and the source driver comprises the static electricity detection module;

if the source driver has static electricity, the source driver outputs a static electricity notification signal to the time controller;

the time controller detecting that the source driver has static electricity according to the static electricity notification signal.

5. The electrostatic ignition protection method of the source driver of the display device according to claim 1, wherein the time controller controlling the source driver not to output the driving signal for the preset duration comprises following steps:

the time controller outputting a second control signal to the power management chip;

the power management chip outputting an operating voltage of 0 to the source driver for the preset duration according to the second control signal;

the source driver being in an inoperative state under action of the operating voltage of 0 for the preset duration.

6. The electrostatic ignition protection method of the source driver of the display device according to claim 1, wherein the time controller controlling the source driver not to output the driving signal for the preset duration comprises following steps:

the time controller outputting a third control signal to the source driver;

the source driver resetting a register in the source driver according to the third control signal.

7. The electrostatic ignition protection method of the source driver of the display device according to claim 1, wherein the time controller detecting whether the source driver has static electricity comprises following steps:

the time controller detecting whether the source driver is in a short circuit state caused by static electricity.

8. A display device, comprising:

a time controller;

a source driver electrically connected to the time controller; and a power management chip electrically connected to both the time controller and the source driver; wherein:

the time controller is configured to detect whether the source driver has static electricity, and when the source driver has static electricity, the time controller controls the source driver not to output a driving signal for a preset duration and the preset duration is greater than an ignition threshold duration;

wherein after the display device is powered on, the time controller outputs a first control signal to the power management chip, the time controller and the source driver in an operating state are configured to perform a detection training to detect whether the source driver has static electricity, and the time controller is configured to detect that the source driver has static electricity according to a detection training failure;

the power management chip is configured to output an operating low voltage to the source driver according to the first control signal;

the source driver is in the operating state under action of the operating low voltage and is configured to perform the detection training with the time controller, and if the source driver has static electricity, the source driver pulls down a locked pin for training, and the detection training fails.

9. The display device according to claim 8, wherein a value range of the operating low voltage is greater than 0 V and less than 4 V.

10. The display device according to claim 8, wherein the source driver comprises a static electricity detection module, the static electricity detection module detects whether the source driver has static electricity when the display device displays;

if the source driver has static electricity, the source driver outputs a static electricity notification signal to the time controller;

the time controller is further configured to detect that the source driver has static electricity according to the static electricity notification signal.

11. The display device according to claim 8, wherein the time controller is configured to output a second control signal to the power management chip;

the power management chip is configured to output an operating voltage of 0 to the source driver for the preset duration according to the second control signal;

the source driver is in an inoperative state under action of the operating voltage of 0 for the preset duration.

12. The display device according to claim 8, wherein the time controller is configured to output a third control signal to the source driver, and the source driver is configured to reset a register in the source driver according to the third control signal.

13. The display device according to claim 8, wherein the time controller is configured to detect whether the source driver is in a short circuit state caused by static electricity to detect whether the source driver has static electricity.

* * * * *